US006120960A

United States Patent [19]

Aoki et al.

[11] Patent Number: 6,120,960

[45] Date of Patent: Sep. 19, 2000

[54] IMAGE FORMING METHOD AND DRY TONER THEREFOR

[75] Inventors: Mitsuo Aoki, Numazu; Akira Oyamaguchi; Nobutaka Kinoshita, both of Shizuoka-ken, all of Japan

[73] Assignee: Ricoh Company, Ltd., Tokyo, Japan

[21] Appl. No.: 09/316,364

[22] Filed: May 21, 1999

[30] Foreign Application Priority Data

May 21, 1998 [JP] Japan ..... 10-156802

[51] Int. Cl.[7] ..... G03G 13/20; G03G 9/087

[52] U.S. Cl. ..... 430/109; 430/111; 430/124

[58] Field of Search ..... 430/106, 109, 430/111, 124

[56] References Cited

U.S. PATENT DOCUMENTS

| | | | |
|---|---|---|---|
| 4,562,136 | 12/1985 | Inoue et al. | 430/107 |
| 4,590,141 | 5/1986 | Aoki et al. | 430/108 |
| 4,908,290 | 3/1990 | Watanabe et al. | 430/106.6 |
| 4,933,250 | 6/1990 | Nakayama et al. | 430/106.6 |
| 4,956,258 | 9/1990 | Watanabe et al. | 430/109 |
| 4,980,258 | 12/1990 | Aoki et al. | 430/110 |
| 5,061,588 | 10/1991 | Fushimi et al. | 430/109 |
| 5,380,616 | 1/1995 | Aoki et al. | 430/110 |
| 5,804,350 | 9/1998 | Sekiguchi et al. | 430/110 |
| 5,879,848 | 3/1999 | Kurose et al. | 430/110 |
| 5,955,234 | 9/1999 | Matsunaga et al. | 430/110 |

FOREIGN PATENT DOCUMENTS

| | | |
|---|---|---|
| 0 247 248 | 12/1987 | European Pat. Off. . |
| 0 801 333 | 10/1997 | European Pat. Off. . |
| 0 864 939 | 9/1998 | European Pat. Off. . |
| 07120996 | 4/1995 | Japan . |
| 07199583 | 8/1995 | Japan . |
| 08314300 | 11/1996 | Japan . |
| 09190013 | 7/1997 | Japan . |
| 09269695 | 10/1997 | Japan . |
| 10039539 | 2/1998 | Japan . |

*Primary Examiner*—John Goodrow

*Attorney, Agent, or Firm*—Oblon, Spivak, McClelland, Maier & Neustadt, P.C.

[57] ABSTRACT

A toner including a colorant and a binder resin, wherein the ratio of a melt viscosity η120 of the toner at 120° C. to a melt viscosity η100 of the toner at 100° C. is greater than 0.06 and less than 0.15. An image forming method is provided which includes the steps of forming a toner image on a receiving material with the toner and heating the toner image to fix the toner image. Provided that the toner image has a gloss y when a heating temperature in the heating step is x, the gloss y preferably changes depending on the heating temperature x such that the relationship between the gloss y and the heating temperature x, y=f(x), is within the range between a line 1, f(x)=0.08x−6, and a line 2, f(x)=0.6x−50.

36 Claims, 1 Drawing Sheet

IMAGE FORMING METHOD AND DRY TONER THEREFOR

BACKGROUND OF THE INVENTION

1. Field of the Invention

The present invention relates to an image forming method in which toner images are formed by developing electrostatic latent images which are formed by electrophotography etc. and to a toner useful for the image forming method.

2. Discussion of the Background

As for electrophotography, various methods have been disclosed in, for example, U.S. Pat. No. 2,297,691, and Japanese Patent Publications Nos. 49-23910 and 43-24748.

Images are typically formed as follows:

(1) a photoconductor is entirely charged with a charging device;

(2) the photoconductor is exposed to imagewise light to form an electrostatic latent image thereon;

(3) the electrostatic latent image is developed with a dry toner to form a toner image on the photoconductor;

(4) the toner image is transferred onto an image receiving material such as a paper sheet; and (5) the toner image transferred on the image receiving material is then fixed upon application of heat and/or pressure to prepare a hard copy.

Dry toners for use in such image forming methods typically include a binder resin and a colorant, and optionally include a charge controlling agent and a releasing agent. The properties requisite for these dry toners include good fixing ability, charging ability, fluidity, stability to environmental changes, mechanical strength, and ability to be pulverized. In color toners such as yellow, magenta, cyan and black toners for use in formation of full color images, gloss and transparency of fixed toner images are important properties in addition to these properties. Recently, a need for gloss of images are increasingly required even for monochrome toner images, or two or three color toner images as well as full color toner images.

In attempting to improve the gloss of fixed toner images, various methods have been disclosed. Japanese Laid-Open Patent Publications Nos. 7-120996 and 7-199583 have disclosed methods in which the glosses of four color toner images are uniformed by relatively decreasing the gloss of the black toner image. Japanese Laid-Open Patent Publication No. 8-314300 discloses a toner having a fixing property in which the gloss of the resultant toner images is controlled so as to fall in a predetermined range even when the fixing temperature changes in a predetermined range. Japanese Laid-Open Patent Publication No. 9-269695 discloses an image forming method in which the gloss of toner images is controlled by changing at least one of fixing conditions such as fixing speed, fixing pressure, fixing temperature and fixing position.

Toner image fixing methods are broadly classified into two methods, i.e., contact fixing methods and non-contact fixing methods. Typical contact fixing methods include heat roller fixing methods. Typical non-contact fixing methods include flash fixing methods and oven fixing methods (i.e., methods of fixing toner in a heated atmosphere).

The background fixing techniques mentioned above relate to heat roller fixing methods. When heat roller fixing methods are used, a releasing agent is typically used in the toner used. This is because by including a releasing agent in a toner an offset problem in that toner images adhere to a heat roller can be avoided. Suitable releasing agents useful for preventing the offset problem include waxes such as low molecular weight polypropylene and polyethylene, which are typically included in background toners, and silicone oils which are typically coated on the surface of a heat roller.

When a releasing agent is included in a toner, the transparency of the resultant toner decreases, resulting in deterioration of color reproduction of the resultant color images. In addition, these releasing agents tend to rise to the surface of the toner particles (so-called "a bleed-out phenomenon"), and therefore a film tends to be formed on toner-charge applying members such as blades and carriers, resulting in deterioration of these toner-charge applying members (so-called "a spent-developer problem").

In the methods in which a releasing agent is continuously coated on the surface of a heat roller, it is difficult to uniformly coat the releasing agent on the surface of the roller for a long time, resulting in changes of the gloss of the resultant toner images. In addition, the methods have a drawback in that a large size fixing unit is needed because a releasing agent has to be continuously supplied to the surface of a heat roller.

Specific examples of the non-contacting fixing methods include oven fixing methods in which hot air is applied to a receiving material having toner images thereon to fix the images, and flash fixing methods in which visible light or infrared light, which can be absorbed in toners, irradiates toner images to heat and fix the toner images. Among these non-contacting methods, oven fixing methods are preferable for fixing full color toner images.

FIG. 1 is a schematic view illustrating an oven fixing device. In FIG. 1, numerals 1–4 denote an image receiving material having toner images T thereon, a heat source, a cover and a feeding belt. The rotating direction of the feeding belt 4 is shown by a solid line arrow. The image receiving sheet is fed in a direction shown by a broken-line arrow to fix the toner image T.

The advantages of the oven fixing methods are as follows:

(1) an image having a wide area can be fixed at a time;

(2) it is not necessarily needed that heat energy is always supplied to a fixing device;

(3) fixing degree of toner images is hardly affected by the constituents and/or thickness of the receiving materials; and (4) resolution of fixed toner images is not deteriorated in the fixing process because the toner images do not contact a member such as heat rollers during the fixing process.

However, the oven fixing methods have a drawback in that fixed toner images tend to have low gloss because pressure is not applied during a heating operation in the fixing process.

In attempting to improve this drawback, Japanese Laid-Open Patent Publication No. 9-190013 discloses a toner which includes a specified epoxy resin as a binder resin and by which toner images having a high gloss can be obtained even when used in a non-contact fixing method. According to this Publication, full color toner images having good preservation properties and good clearness can be stably obtained.

Japanese Laid-Open Patent Publication 10-39539 discloses a toner which includes inorganic fine particles and which produces toner images having a uniform gloss because the toner has a specified melt viscosity and a specified BET surface area.

As mentioned above, these background methods intend to stably obtain toner images having a high gloss. However, gloss of toner images is a matter of individual's tastes.

Therefore, when toner images are fixed so that the resultant toner images have a constant high gloss using one of these fixing methods, the toner image cannot necessarily satisfy all persons.

Because of these reasons, a need exists for an image forming method in which toner images having desired gloss can be easily obtained without changing toners.

SUMMARY OF THE INVENTION

Accordingly, an object of the present invention is to provide an image forming method in which toner images having a desired gloss can be easily obtained without changing toners.

Another object of the present invention is to provide a toner which exhibits a good fixing property even when fixed at a relatively low temperature to decrease the gloss of the resultant toner images.

Briefly these objects and other objects of the present invention as hereinafter will become more readily apparent can be attained by an image forming method which includes the steps of:

forming a toner image on a receiving material with a toner including a colorant and a binder resin, wherein the toner has the following melt viscosity property:

$$0.06<\eta120/\eta100<0.15$$

wherein η120 is the melt viscosity of the toner measured at 120° C. with a flow tester and η100 is the melt viscosity of the toner measured at 100° C. with a flow tester; and heating the toner image to fix the toner image on the receiving material.

Provided that the toner image has a gloss y when the heating temperature in the heating step is x, the gloss y preferably changes depending on the heating temperature x such that the relationship between the gloss y and the heating temperature x, y=f(x), is in the range between a line 1, f(x)=0.08x−6, and a line 2, f(x)=0.6x−50.

In another aspect of the present invention, an electrophotographic toner is provided which includes a colorant and a binder resin and which is useful for non-contact fixing methods, wherein the toner has the following melt viscosity property:

$$0.06<\eta120/\eta100<0.15$$

wherein η120 is the melt viscosity of the toner measured at 120° C. with a flow tester, and η100 is the melt viscosity of the toner measured at 100° C. with a flow tester.

Preferably, η100 is in the range of from $2.5\times10^3$ to $5.5\times10^3$ Pa·s and η120 is in the range of from $1.5\times10^2$ to $6.55\times10^2$ Pa·s.

The binder resin of the toner preferably includes at least a resin selected from the group consisting of polyester resins and epoxy resins.

The binder resin preferably includes a resin having a weight average molecular weight of from 6000 to 20000 and a molecular weight distribution of from 100 to 500000 and a resin having a weight average molecular weight of from 4000 to 8000 and a molecular weight distribution of from 100 to 10000.

When a plurality of color toners including a black toner are used for preparing a color image, the black toner preferably has a relatively high melt viscosity compared to the other toners.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides a dry toner which includes a colorant and a binder resin and which is useful for non-contact fixing methods, wherein the toner has a melt viscosity expressed by the following relationship:

$$0.06<\eta120/\eta100<0.15$$

wherein η120 is the melt viscosity of the toner measured at 120° C. with a flow tester, and η100 is the melt viscosity of the toner measured at 100° C. with a flow tester.

When the ratio η120/η100 is not greater than 0.06, the gloss of the resultant fixed toner images excessively changes depending on the fixing temperature, resulting in formation of fixed toner images having uneven gloss, or the fixing ability of the toner images deteriorates. In contrast, when the ratio η120/η100 is not less than 0.15, the gloss of the resultant fixed toner images hardly changes depending on the fixing temperature or the fixing ability of the toner images deteriorates.

The gloss of the toner images is measured with GLOSS METER manufactured by NIPPON DENSHOKU KOGYO CO., LTD. under a condition that the light reflected at an angle of 60° is measured.

The melt viscosity of toner is measured by a flow tester CFT-500 C manufactured by Shimazu Corp. The measuring conditions are as follows:

Extruding pressure: 0.9806 Mpa

Heating speed: 3° C./min

Diameter of a die: 0.5 mm

Length of the die: 1.0 mm

The melt viscosity η is obtained by the following equation:

$$\eta=\tau/\gamma=\pi D^4P/128LQ$$

wherein P is an extruding pressure (Pa), D is a diameter (mm) of the die used, L is a length (mm) of the die used, t is a measuring time (s), and Q is represented by the following equation:

$$Q=X/10\times A/t(cm3/s)$$

wherein X is a moving distance (mm) of a piston during the measuring time and A is a cross-sectional area ($cm^2$) of the piston.

In the image forming method of the present invention, it is important that provided that the toner image has a gloss y when the image is heated at a heating temperature x, the gloss y changes depending on the heating temperature such that the relationship between the gloss y and the heating temperature x, y=f(x), is in the range between a line 1, f(x)=0.08x−6, and a line 2, f(x)=0.6x−50. The lines 1 and 2 are shown in FIG. 2.

Figure 2:
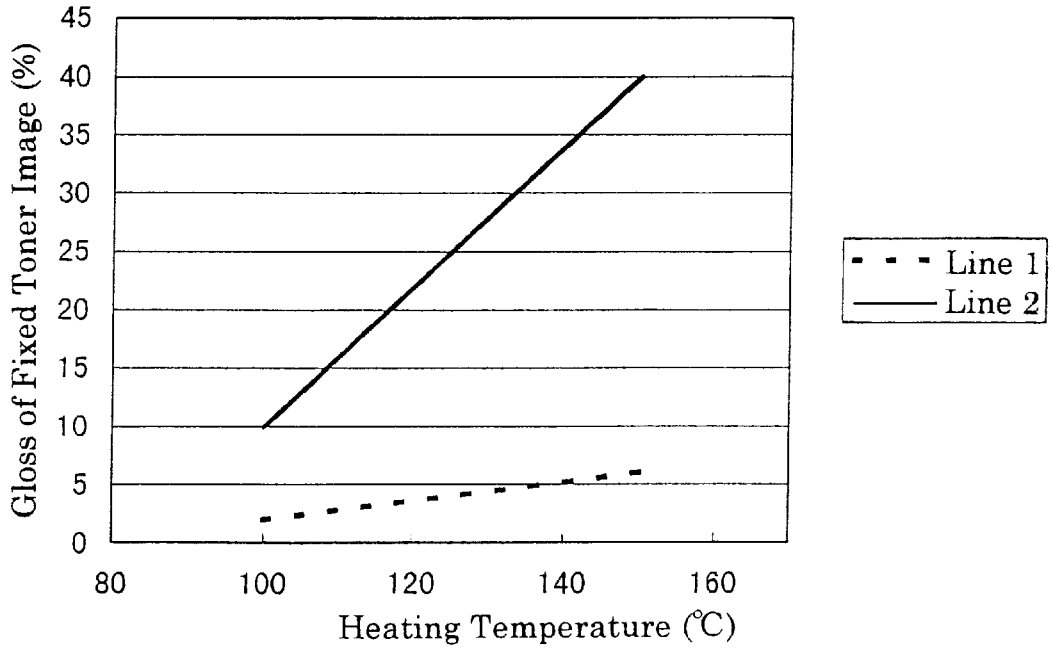
FIG. 2 is a graph illustrating a line 1 and a line 2 between which the gloss of fixed toner images preferably changes depending on the fixing temperature in the image forming method of the present invention.

In FIG. 2, a heating temperature (° C.) is plotted on the horizontal axis and the gloss (%) of the resultant fixed toner image is plotted on the vertical axis. The dotted line is the line 1 and the solid line is the line 2.

When the relationship equation between a fixing temperature x and the gloss y of the resultant fixed toner, y=f(x), is below the line 1, the gloss of the resultant fixed toner image is too low, or the dependency of the gloss on the fixing temperature is too low, and therefore the change of the gloss cannot be visually observed.

In contrast, when the relationship equation, y=f(x), is over the line 2, the gloss of the resultant fixed toner image is too high, and therefore an image having a relatively low gloss cannot be obtained. At this point, the fixing temperature means the temperature of the atmosphere surrounding the toner image.

The toner of the present invention preferably has a melt viscosity η100, which is measured by a flow tester, ranging from $2.5\times10^3$ to $5.5\times10^3$ Pa·s and a melt viscosity η120 ranging from $1.5\times10^2$ to $6.55\times10^2$ Pa·s.

When η100 is greater than $5.5\times10^3$, the fixing properties of the fixed toner image tend to deteriorate and the gloss of the resultant toner image tends not to be satisfactory. When η100 is less than $2.55\times10^3$, the preservability of the toner tends to deteriorate.

When η120 is greater than $6.5\times10^2$, the fixing properties of the resultant fixed toner images tend to deteriorate, and when η120 is less than $1.5\times10^2$, the preservability of the toner tend to deteriorate.

The melt viscosity of a toner can be controlled by using proper binder resins and kneading toner constituents under proper conditions when the toner is prepared.

The toner of the present invention preferably includes at least one of polyester resins and epoxy resins. These resins can impart good preservability and color properties to color toners.

Suitable polyester resins for use in the toner of the present invention include polyester resins which are prepared by a condensation polymerization of an alcohol and a carboxylic acid. Specific examples of such alcohols for use in the polyester resins include glycols such as ethylene glycol, diethylene glycol, triethylene glycol and propylene glycol; 1,4-bis(hydroxymetha)cyclohexane, etherificated bisphenols such as bisphenol A, dihydric alcohol monomers, and polyhydric alcohol monomers.

Specific examples of the carboxylic acids for use in the polyester resins include organic dibasic acid monomers such as maleic acid, fumaric acid, phthalic acid, isophthalic acid, terephthalic acid, succinic acid, malonic acid; and polybasic carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxylpropane, and 1,2,7,8-octanetetracarboxylic acid.

Suitable epoxy resins for use in the toner of the present invention include epoxy resins which are prepared by a condensation polymerization of a bisphenol compound and an epichlorohydrin compound. Specific examples of such a bisphenol compound include adducts of a dihydric phenol with an alkylene oxide such as reaction products of bisphenol A or bisphenol F with one or more of ethylene oxide, propylene oxide, or butylene oxide. The epoxy resins for use in the present invention are prepared by reacting the thus prepared bisphenol products with epichlorohydrin or β-methylepichlorohydrin to form a glycidyl group in the bisphenol products. Among these epoxy resins, glycidyl ethers of adducts of bisphenol A with an alkylene oxide are preferable.

In addition, among these polyester resins and epoxy resins, resins having a transition temperature of from 58 to 75° C. are preferably used in the present invention.

In the image forming method of the present invention, a plurality of color toners can be used to form a color image. In this case, each of the plurality of color toners preferably has the melt viscosity properties and the gloss properties mentioned above.

When a plurality of color toners including a black toner are used to form a color toner image, the melt viscosity of the black toner is preferably higher than those of other color toners such as yellow, magenta and cyan toner to produce color images having good image qualities in which a plurality of color images in a copy sheet have almost the same gloss. The reason is the following.

When an oven fixing device is used, toner is fixed by hot air. Since black toner absorbs light such as visible light and infrared light, the black toner images tend to have a higher gloss than other color toner images, resulting in formation of toner images in which only black toner images are emphasized. In this case, when a black toner having a melt viscosity higher than those of other color toners is used, all the color toner images achieve almost the same gloss when fixed at a temperature. Thus, the problem in that a plurality of color images in a copy sheet have different glosses can be improved, and images having good image qualities can be obtained.

The ratio of the melt viscosity of black toner $\eta_{BK}$ to the melt viscosity of other color toner $\eta_C$ is preferably not greater than 1.1 to obtain good image qualities in which each of the color toner images achieves almost the same gloss.

In the toner of the present invention, known resins other than polyester resins and epoxy resins can also be employed as a binder resin. Specific examples of such resins include homopolymers or copolymers of styrene or styrene derivatives such as polystyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-α-chloroacrylic acid methyl ester copolymers, and styrene-acrylonitrile-acrylate copolymers; vinyl chloride resins, rosin modified maleic acid resins, phenolic resins, polyethylene resins, polypropylene resins, petroleum resins, polyurethane resins, ketone resins, ethylene-ethylacrylate copolymers, xylene resins, and polyvinyl butyral resins. These resins may be used alone or in combination. Needless to say, these resins may be used in combination with polyester resins, and/or epoxy resins.

The method for manufacturing these resins is not particularly limited, and known polymerization methods such as bulk polymerization, solution polymerization, emulsion polymerization, and suspension polymerization can be employed to prepare these resins.

In order to obtain the gloss property of toner images such that the gloss of the resultant fixed toner images properly changes depending on the fixing temperature, it is preferable to use a combination of a resin (1) having a low molecular weight and a broad distribution of molecular weight and a resin (2) having a low molecular weight and a narrow distribution of molecular weight as a binder resin of toner. The weight average molecular weights of the resins (1) and (2) are preferably from 6000 to 20000 and from 4000 to 8000, respectively. The molecular weight distribution of the resins (1) and (2) is preferably from 100 to 500000 and from 100 to 10000, respectively. In detailed description, when a toner having this resin combination is fixed at a relatively low temperature, the resultant fixed toner image has a relatively low gloss. In contrast, when the toner image is fixed at a relatively high temperature, the resultant fixed toner image has a relatively high gloss. At this point, when a toner including such a resin combination is prepared, the toner is preferably kneaded strongly at a temperature not higher than the glass transition temperature of the resin (1) or not higher than the softening point of the resin (2).

Suitable colorants for use in the toner of the present invention include known pigments and dyes which have been used as a colorant for toners. Specific examples of such pigments and dyes include carbon black, lamp black, iron black, ultramarine blue, Nigrosine dyes, Aniline Blue, chalco-oil blue, Du Pont Oil Red, Quinoline Yellow, Methylene Blue chloride, Phthalocyanine Blue, Phthalocyanine Green, Hansa Yellow, Rhodamine 6C Lake, chrome yellow, quinacridone, Benzidine Yellow, Malachite Green, Malachite Green hexalate, Oil Black, azo oil black, Rose Bengale, monoazo type pigments, disazo type pigments, and trisazo type pigments.

The toner of the present invention preferably includes a polarity controlling agent to control the polarity of the toner. Suitable polarity controlling agents for use in the toner of the present invention include Nigrosine dyes, quarternary ammonium salts, polymers having an amino group, azo dyes including a metal, complex compounds of salicylic acid, and phenolic compounds. Among these compounds, quarternary ammonium salts, polymers having an amino group, and complex compounds of salicylic acid are preferable because they do not affect the color properties of the resultant toner.

The toner of the present invention may include additives such as silica, aluminum oxide and titanium oxide. When it is desired to improve the fluidity of toner particles, silica or rutile-type titanium oxide, which are treated with a hydrophobic treatment and which have an average primary particle diameter of from 0.001 to 1 $\mu$m and preferably from 0.005 to 0.1 $\mu$m, are preferably included in a toner. More preferably, silica and titanium oxide, which are treated with an organic silane, are used. The content of the additives in the toner is from 0.1 to 5% by weight, and preferably from 0.2 to 2% by weight.

When the toner of the present invention is used as a two-component toner, a suitable carrier includes known materials such as powders of glass, iron, ferrite, nickel, zircon, and silica, which have a particle diameter of from 30 to 1000 $\mu$m, or particles in which the powders mentioned above is coated with a resin such as styrene-acrylate copolymers, silicone resins, polyamide resins, and polyvinylidene fluoride.

Figure 1:
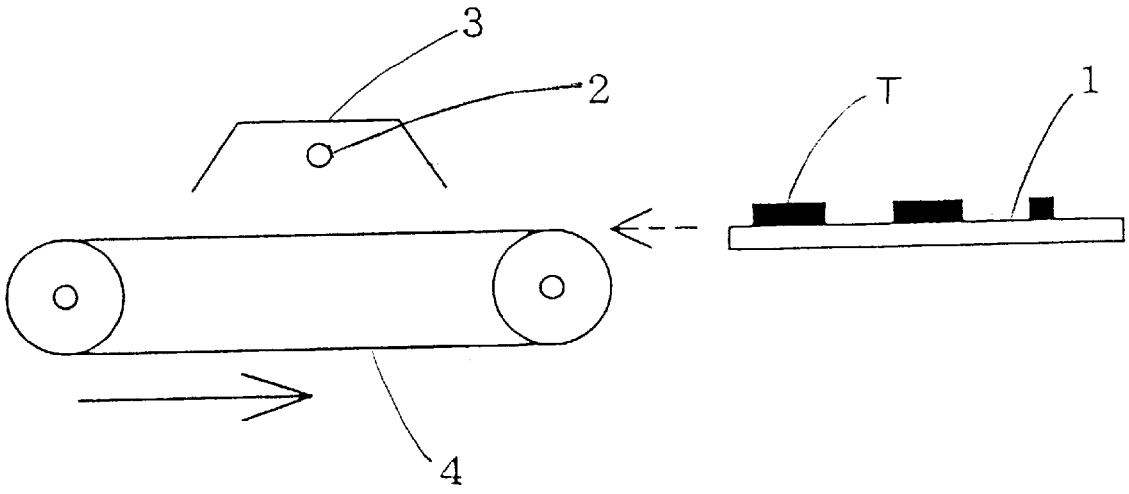
FIG. 1 is a schematic view illustrating a non-contact fixing device useful for the image forming method of the present invention.

In the image forming method and the toner of the present invention, the fixing method is not limited to non-contact fixing methods, and are used for known fixing methods can also be used. However, when color toners are used, it is preferable to use an oven fixing method. FIG. 1 is a schematic view of an oven fixing device useful for the image forming method of the present invention. As mentioned before, in FIG. 1, numerals 1–4 denote an image receiving material having toner images T thereon, a heat source, a cover and a feeding belt. The rotating direction of the feeding belt 4 is shown by a solid-line arrow and the feeding direction of the image receiving material is shown by a broken-line arrow. Suitable heat energy for fixing toner images, which depends on the composition and particle diameter of the toner used, is from 0.12 to 0.20 cal/cm$^2$. The temperature of the atmosphere surrounding the toner images to be fixed is from 80 to 200° C., and preferably from 100 to 160° C.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

In addition, in the descriptions in the following examples, full color toners of yellow, magenta, cyan and black toner are used, however, the toner is not limited thereto, and only a monochrome toner, whose color tone is not also limited, may be used alone or in combination.

EXAMPLES

Example 1

| Preparation of yellow toner (Y1) The following components were mixed, and melted and kneaded using a double-shaft extruder. | |
|---|---|
| Binder resin (styrene-acrylate copolymer/petroleum resin = 80/20) | 95 |
| Negative polarity controlling agent | 1 |
| Colorant (monoazo type yellow pigment) | 4 |

The kneaded mixture was cooled and crushed, and then pulverized with a jet mill and classified to prepare a yellow toner having an average particle diameter of from 8 to 9 $\mu$m.

Preparation of magenta toner (M1), cyan toner (C1) and black toner (BK1)

The procedure for preparation of yellow toner (1) was repeated to prepare a magenta toner (1), a cyan toner (1) and a black toner (1) except that the formulation was replaced with the following formulations.

| Formulation of magenta toner (M1) | |
|---|---|
| Binder resin (styrene-acrylate copolymer/petroleum resin = 80/20) | 94 |
| Negative polarity controlling agent | 1 |
| Colorant (quinacridone type magenta pigment) | 5 |
| **Formulation of cyan toner (C1)** | |
| Binder resin (styrene-acrylate copolymer/petroleum resin = 80/20) | 96 |
| Negative polarity controlling agent | 1 |
| Colorant (Phthalocyanine type cyan pigment) | 3 |
| **Formulation of black toner (BK1)** | |
| Binder resin (styrene-acrylate copolymer/petroleum | 95 |

-continued

| | |
|---|---|
| resin = 80/20) | |
| Negative polarity controlling agent | 1 |
| Colorant (carbon black) | 4 |

The thus prepared four color toners were set in an electrophotographic copier (PRETER 550 manufactured by RICOH CO., LTD.) and a full color toner image which was not fixed was formed on a receiving paper. At this point, the adhering weight of each color toner was controlled so as to be 1.0±0.5 mg/cm$^2$. The thus prepared color toner image was fixed at a temperature of 100 and 150° C., while the receiving paper was fed at a speed of 200 mm/sec.

The method for evaluating the fixing property of the color toner was as follows:

(1) a piece of an adhesive tape (Scotch Mending Tape manufactured by Sumitomo 3M Limited) was attached on the fixed image with a predetermined pressure;

(2) the tape was slowly peeled; and (3) the fixing rate of the image was determined by the following equation:

Fixing rate (%)=(ID2/ID1)×100 wherein ID1 represents an image density of the image before the peeling test with an adhesive tape, and ID2 represents an image density after the peeling test.

A full color toner image which was fixed at 100° C. was compared with a full color toner image which was fixed at 150° C. in respect to the gloss of the images. The differences of the glosses were classified into 5 ranks which are as follows:

Rank 1: The gloss of the toner image fixed at 150° C. is almost the same as that of the toner image fixed at 100° C.

Rank 2: The gloss of the toner image fixed at 150° C. is slightly different from that of the toner image fixed at 100° C.

Rank 3: The gloss of the toner image fixed at 150° C. is different a little from that of the toner image fixed at 100° C.

Rank 4: The gloss of the toner image fixed at 150° C. is different from that of the toner image fixed at 100° C.

Rank 5: The gloss of the toner image fixed at 150° C. is satisfactorily different from that of the toner images fixed at 100° C., and the image fixed at 150° C. has a high gloss and the image fixed at 100° C. has a low gloss.

In addition, the melt viscosity of each color toner was measured with a flow tester at 100° C. and 120° C.

The results of these evaluations are shown in Table 1.

Comparative Example 1

The procedures for preparation of the color toners in Example 1 were repeated except that the formulations were replaced by the following formulations.

| | |
|---|---|
| Formulation of yellow toner (Y11) | |
| Binder resin | 94 |
| (styrene resin/petroleum resin = 40/60) | |
| Negative polarity controlling agent | 2 |
| Colorant (monoazo type yellow pigment) | 4 |

-continued

| | |
|---|---|
| Formulation of magenta toner (M11) | |
| Binder resin | 93 |
| (styrene resin/petroleum resin = 40/60) | |
| Negative polarity controlling agent | 2 |
| Colorant (quinacridone type magenta pigment) | 5 |
| Formulation of cyan toner (C11) | |
| Binder resin | 95 |
| (styrene resin/petroleum resin = 40/60) | |
| Negative polarity controlling agent | 2 |
| Colorant (Phthalocyanine type cyan pigment) | 3 |
| Formulation of black toner (BK11) | |
| Binder resin | 94 |
| (styrene resin/petroleum resin = 40/60) | |
| Negative polarity controlling agent | 2 |
| Colorant (carbon black) | 4 |

Thus, comparative color toners were prepared. The results of evaluation of these toners are shown in Table 1.

Comparative Example 2

The procedures for preparation of the color toners in Example 1 were repeated except that the formulations were replaced by the following formulations.

| | |
|---|---|
| Formulation of yellow toner (Y12) | |
| Binder resin | 94 |
| (styrene-n-butyl acrylate copolymer) | |
| Negative polarity controlling agent | 2 |
| Colorant (monoazo type yellow pigment) | 4 |
| Formulation of magenta toner (M12) | |
| Binder resin | 93 |
| (styrene-n-butyl acrylate copolymer) | |
| Negative polarity controlling agent | 2 |
| Colorant (quinacridone type magenta pigment) | 5 |
| Formulation of cyan toner (C12) | |
| Binder resin | 95 |
| (styrene-n-butyl acrylate copolymer) | |
| Negative polarity controlling agent | 2 |
| Colorant (Phthalocyanine type cyan pigment) | 3 |
| Formulation of black toner (BK12) | |
| Binder resin | 94 |
| (styrene-n-butyl acrylate copolymer) | |
| Negative polarity controlling agent | 2 |
| Colorant (carbon black) | 4 |

Thus, comparative color toners were prepared. The results of evaluation of these toners are shown in Table 1.

Example 2

The procedures for preparation of the color toners in Example 1 were repeated except that the formulations were replaced by the following formulations.

| Formulation of yellow toner (Y2) | |
|---|---|
| Binder resin (styrene-acrylate copolymer) | 95 |
| Negative polarity controlling agent | 1 |
| Colorant (monoazo type yellow pigment) | 4 |
| Formulation of magenta toner (M2) | |
| Binder resin (styrene-acrylate copolymer) | 94 |
| Negative polarity controlling agent | 1 |
| Colorant (quinacridone type magenta pigment) | 5 |
| Formulation of cyan toner (M2) | |
| Binder resin (styrene-acrylate copolymer) | 96 |
| Negative polarity controlling agent | 1 |
| Colorant (Phthalocyanine type cyan pigment) | 3 |
| Formulation of black toner (BK2) | |
| Binder resin (styrene-acrylate copolymer) | 95 |
| Negative polarity controlling agent | 1 |
| Colorant (carbon black) | 4 |

Thus, color toners of the present invention were prepared. The results of evaluation of these toners are shown in Table 1.

Example 3

The procedures for preparation of the color toners in Example 1 were repeated except that the formulations were replaced by the following formulations.

| Formulation of yellow toner (Y3) | |
|---|---|
| Binder resin (polystyrene/styrene-acrylate copolymer = 60/40) | 95 |
| Negative polarity controlling agent | 1 |
| Colorant (monoazo type yellow pigment) | 4 |
| Formulation of magenta toner (M3) | |
| Binder resin (polystyrene/styrene-acrylate copolymer = 60/40) | 94 |
| Negative polarity controlling agent | 1 |
| Colorant (quinacridone type magenta pigment) | 5 |
| Formulation of cyan toner (C3) | |
| Binder resin (polystyrene/styrene-acrylate copolymer = 60/40) | 96 |
| Negative polarity controlling agent | 1 |
| Colorant (Phthalocyanine type cyan pigment) | 3 |
| Formulation of black toner (BK3) | |
| Binder resin (polystyrene/styrene-acrylate copolymer = 60/40) | 95 |
| Negative polarity controlling agent | 1 |
| Colorant (carbon black) | 4 |

Thus, color toners of the present invention were prepared. The results of evaluation of these toners are shown in Table 1.

Example 4

The procedures for preparation of the color toners in Example 1 were repeated except that the formulations were replaced by the following formulations.

| Formulation of yellow toner (Y4) | |
|---|---|
| Binder resin (polyester resin) | 94 |
| Negative polarity controlling agent | 2 |
| Colorant (monoazo type yellow pigment) | 4 |
| Formulation of magenta toner (M4) | |
| Binder resin (polyester resin) | 93 |
| Negative polarity controlling agent | 2 |
| Colorant (quinacridone type magenta pigment) | 5 |
| Formulation of cyan toner (C4) | |
| Binder resin (polyester resin) | 95 |
| Negative polarity controlling agent | 2 |
| Colorant (Phthalocyanine type cyan pigment) | 3 |
| Formulation of black toner (BK4) | |
| Binder resin (polyester resin) | 94 |
| Negative polarity controlling agent | 2 |
| Colorant (carbon black) | 4 |

Thus, color toners of the present invention were prepared. The results of evaluation of these toners are shown in Table 1.

Example 5

The procedures for preparation of the color toners in Example 1 were repeated except that the formulations were replaced by the following formulations.

| Formulation of yellow toner (Y5) | |
|---|---|
| Binder resin (epoxy resin) | 94 |
| Negative polarity controlling agent | 2 |
| Colorant (monoazo type yellow pigment) | 4 |
| Formulation of magenta toner (M5) | |
| Binder resin (epoxy resin) | 93 |
| Negative polarity controlling agent | 2 |
| Colorant (quinacridone type magenta pigment) | 5 |
| Formulation of cyan toner (C5) | |
| Binder resin (epoxy resin) | 95 |
| Negative polarity controlling agent | 2 |
| Colorant (Phthalocyanine type cyan pigment) | 3 |
| Formulation of black toner (BK5) | |
| Binder resin (epoxy resin) | 94 |
| Negative polarity controlling agent | 2 |
| Colorant (carbon black) | 4 |

Thus, color toners of the present invention were prepared. The results of evaluation of these toners are shown in Table 1.

Example 6

The procedures for preparation of the color toners in Example 1 were repeated except that the formulations were replaced by the following formulations.

| Formulation of yellow toner (Y6) | |
|---|---|
| Binder resin (polyester resin) | 95 |
| Negative polarity controlling agent | 1 |
| Colorant (monoazo type yellow pigment) | 4 |
| **Formulation of magenta toner (M6)** | |
| Binder resin (polyester resin) | 94 |
| Negative polarity controlling agent | 1 |
| Colorant (quinacridone type magenta pigment) | 5 |
| **Formulation of cyan toner (C6)** | |
| Binder resin (polyester resin) | 96 |
| Negative polarity controlling agent | 1 |
| Colorant (Phthalocyanine type cyan pigment) | 3 |
| **Formulation of black toner (BK6)** | |
| Binder resin (epoxy resin) | 94 |
| Negative polarity controlling agent | 2 |
| Colorant (carbon black) | 4 |

Thus, color toners of the present invention were prepared. The results of evaluation of these toners are shown in Table 1.

Example 7

The procedures for preparation of the color toners in Example 1 were repeated except that the formulations were replaced by the following formulations.

| Formulation of yellow toner (Y7) | |
|---|---|
| Binder resin (polyester resin) | 95 |
| Negative polarity controlling agent | 1 |
| Colorant (monoazo type yellow pigment) | 4 |
| **Formulation of magenta toner (M7)** | |
| Binder resin (polyester resin) | 94 |
| Negative polarity controlling agent | 1 |
| Colorant (quinacridone type magenta pigment) | 5 |
| **Formulation of cyan toner (C7)** | |
| Binder resin (polyester resin) | 96 |
| Negative polarity controlling agent | 1 |
| Colorant (Phthalocyanine type cyan pigment) | 3 |
| **Formulation of black toner (BK7)** | |
| Binder resin (epoxy resin/styrene-acrylate copolymer = 80/20) | 94 |
| Negative polarity controlling agent | 2 |
| Colorant (carbon black) | 4 |

Thus, color toners of the present invention were prepared. The results of evaluation of these toners are shown in Table 1.

TABLE 1

| | Toner No. | Melt viscosity (η) η 100 (Pa · s) | η 120 (Pa · s) | η 120/η 100 | Gloss (%) 100° C. | 150° C. | Gloss (rank) | Fixing rate (%) |
|---|---|---|---|---|---|---|---|---|
| EX. 1 | Y1 | 7110 | 890 | 0.12 | 2.6 | 9.5 | 4 | 88.5 |
| | M1 | 6520 | 950 | 0.15 | 2.1 | 8.5 | 4 | 85.6 |
| | C1 | 6820 | 930 | 0.14 | 2.4 | 8.9 | 4 | 86.9 |
| | BK1 | 7060 | 920 | 0.13 | 3.4 | 12.8 | 4 | 87.1 |
| Comparative EX. 1 | Y11 | 2450 | 140 | 0.05 | 17.2 | 20.1 | 2 | 79.2 |
| | M11 | 2410 | 130 | 0.05 | 19.2 | 22.3 | 2 | 78.9 |
| | C11 | 2380 | 140 | 0.05 | 17.3 | 19.9 | 2 | 76.7 |
| | BK11 | 2440 | 130 | 0.05 | 22.6 | 25.5 | 2 | 72.6 |
| Comparative EX. 2 | Y12 | 6980 | 1210 | 0.17 | 4.2 | 6.2 | 1 | 68.2 |
| | M12 | 6950 | 1180 | 0.17 | 5.1 | 7.1 | 1 | 64.4 |
| | C12 | 6920 | 1090 | 0.16 | 4.5 | 6.8 | 1 | 62.5 |
| | BK12 | 7120 | 1150 | 0.16 | 7.6 | 8.1 | 1 | 61.8 |
| EX. 2 | Y2 | 4510 | 560 | 0.12 | 5.1 | 21.1 | 4 | 92.6 |
| | M2 | 4720 | 580 | 0.12 | 4.9 | 18.7 | 4 | 93.7 |
| | C2 | 4650 | 610 | 0.13 | 5.1 | 17.9 | 4 | 92.1 |
| | BK2 | 4550 | 590 | 0.13 | 7.9 | 23.5 | 4 | 94.5 |
| EX. 3 | Y3 | 2890 | 240 | 0.08 | 8.5 | 27.8 | 5 | 94.5 |
| | M3 | 2980 | 250 | 0.08 | 7.9 | 26.2 | 5 | 95.2 |
| | C3 | 2880 | 290 | 0.10 | 8.4 | 28.1 | 5 | 93.2 |
| | BK3 | 2950 | 310 | 0.11 | 9.7 | 33.2 | 5 | 94.1 |
| EX. 4 | Y4 | 4510 | 560 | 0.12 | 5.1 | 21.1 | 5 | 97.2 |
| | M4 | 4720 | 580 | 0.12 | 4.9 | 18.7 | 5 | 95.6 |
| | C4 | 4650 | 610 | 0.13 | 5.1 | 17.9 | 5 | 96.4 |
| | BK4 | 4550 | 590 | 0.13 | 7.9 | 23.5 | 5 | 95.9 |
| EX. 5 | Y5 | 4510 | 560 | 0.12 | 5.1 | 21.1 | 5 | 96.6 |
| | M5 | 4720 | 580 | 0.12 | 4.9 | 18.7 | 5 | 95.9 |
| | C5 | 4650 | 610 | 0.13 | 5.1 | 17.9 | 5 | 97.2 |
| | BK5 | 4550 | 590 | 0.13 | 7.9 | 23.5 | 5 | 96.1 |

TABLE 1-continued

| | Toner No. | Melt viscosity (η) η 100 (Pa · s) | η 120 (Pa · s) | η 120/ η 100 | Gloss (%) 100° C. | 150° C. | Gloss (rank) | Fixing rate (%) |
|---|---|---|---|---|---|---|---|---|
| EX. 6 | Y6 | 4880 | 560 | 0.11 | 4.6 | 19.8 | 5 | 97.7 |
| | M6 | 4870 | 550 | 0.12 | 4.1 | 18.4 | 5 | 96.8 |
| | C6 | 4620 | 570 | 0.12 | 4.7 | 20.1 | 5 | 97.2 |
| | BK6 | 5420 | 640 | 0.11 | 4.4 | 18.7 | 5 | 98.6 |
| EX. 7 | Y6 | 3450 | 420 | 0.12 | 6.1 | 23.6 | 5 | 98.7 |
| | M6 | 3410 | 430 | 0.11 | 5.7 | 20.8 | 5 | 98.2 |
| | C6 | 3480 | 430 | 0.13 | 6.4 | 21.8 | 5 | 97.1 |
| | BK6 | 3590 | 450 | 0.13 | 8.8 | 27.6 | 5 | 98.6 |

As can be understood from Table 1, the toner and the image forming method of the present invention can easily provide images having a desired gloss in a range of from a low gloss to a high gloss by changing the fixing temperature.

This document claims priority and contains subject matter related to Japanese Patent Application No. 10-156802, filed on May 21, 1998, incorporated therein by reference.

Having now fully described the invention, it will be apparent to one of ordinary skill in the art that many changes and modifications can be made thereto without departing from the spirit and scope of the invention as set forth therein.

What is claimed as new and is intended to be secured by Letters Patent is:

1. A toner comprising a colorant and a binder resin, wherein the toner has a melt viscosity expressed by the relationship:

$$0.06<\eta120/\eta100<0.15$$

wherein η120 is the melt viscosity of the toner measured at 120° C. with a flow tester, and η100 is the melt viscosity of the toner measured at 100° C. with a flow tester, and wherein η100 is in the range of about $2.5\times10^3$ to about $5.5\times10^3$ Pa·s and η120 is in the range of about $1.5\times10^2$ to about $6.55\times10^2$ Pa·s.

2. The toner according to claim 1, wherein the binder resin comprises a resin selected from the group consisting of polyester resins and epoxy resins.

3. The toner according to claim 1, wherein the binder resin comprises a resin having a weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000.

4. The toner according to claim 1, wherein the colorant is a pigment or dye selected from the group consisting of carbon black, lamp black, iron black, ultramarine blue, Nigrosine dyes, Aniline Blue, chalco-oil blue, DuPont Oil Red, Quinoline Yellow, Methylene Blue chloride, Phthalocyanine Blue, Phthalocyanine Green, Hansa Yellow, Rhodamine 6C Lake, chrome yellow, quinacridone, Benzidine Yellow, Malachite Green, Malachite Green hexalate, Oil Black, azo oil black, Rose Bengale, monoazo pigments, disazo pigments and trisazo pigments.

5. The toner according to claim 1, wherein the toner contains a polarity controlling agent.

6. The toner according to claim 1, wherein the toner contains a hydrophobized particulate filler which has an average primary particle diameter of 0.001 to 1 μ.

7. An image forming method comprising the steps of:

forming a toner image on a receiving material using a toner comprising a colorant and a binder resin, wherein the toner has the melt viscosity property:

$$0.06<\eta120/\eta100<0.15$$

wherein η120 is the melt viscosity of the toner measured at 120° C. with a flow tester, and η100 is the melt viscosity of the toner measured at 100° C. with a flow tester, wherein η100 is in the range of about $2.5\times10^3$ to about $5.5\times10^3$ Pa·s and η120 is in the range of about $1.5\times10^2$ to about $6.55\times10^2$ Pa·s; and heating the toner image to fix the toner image on the receiving material.

8. The image forming method according to claim 7, wherein the heating step is performed using a non-contact fixing device.

9. The image forming method according to claim 7, wherein, provided that the toner image has a gloss y when the heating temperature in the heating step is x, the gloss y changes depending on the heating temperature x such that the relationship between the gloss y and the heating temperature x, y=f(x), is in the range between a line 1, f(x)=0.08x−6, and a line 2, f(x)=0.6x−50.

10. The image forming method according to claim 7, wherein the binder resin comprises a resin selected from the group consisting of polyester resins and epoxy resins.

11. The image forming method according to claim 7, wherein the binder resin comprises a resin having a weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000.

12. An image forming method comprising the steps of:

forming color toner images constituted of a plurality of different color tone images on a receiving material using a plurality of color toners including a black toner, each of the plurality of color toners comprising a colorant and a binder resin, wherein each of the plurality of color toners has the following melt viscosity property:

$$0.06<\eta120/\eta100<0.15$$

wherein η120 is the melt viscosity of each of the plurality of color toners measured at 120° C. with a flow tester, and η100 is the melt viscosity of the color toner measured at 100° C. with a flow tester, wherein η100 is in the range of about $2.5\times10^3$ to about $5.5\times10^3$ Pa·s and η120 is in the range of about $1.5\times10^2$ to about $6.55\times10^2$ Pa·s; and heating the color toner images to fix the color toner images on the receiving material.

13. The image forming method according to claim 12, wherein the heating step is performed using a non-contact fixing device.

14. The image forming method according to claim 12, wherein, provided that each of the plurality of color tone images has a gloss $y_1, y_2, \ldots y_n$, when a heating temperature in the heating step is x, the gloss $y_n$ changes depending on the heating temperature x such that the relationship between the gloss $y_n$ and the heating temperature x, $y_n=f(x)$, is within the range between a line 1, $f(x)=0.08x-6$, and a line 2, $f(x)=0.6x-50$.

15. The image forming method according to claim 12, wherein the binder resin of each of the color toners comprises a resin selected from the group consisting of polyester resins and epoxy resins.

16. The image forming method according to claim 12, wherein the black toner has a higher melt viscosity than the other toners when measured at a heating temperature in the heating step.

17. The image forming method according to claim 16, wherein the melt viscosity of the black toner is less than about 1.1 times higher than the melt viscosity of the other toners.

18. The image forming method according to claim 12, wherein the binder resin of each of said color toners comprises a resin having an weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000.

19. A toner comprising a colorant and a binder resin, wherein the toner has a melt viscosity expressed by the relationship:

$$0.06<\eta120/\eta100<0.15$$

wherein η120 is the melt viscosity of the toner measured at 120° C. with a flow tester, and η100 is the melt viscosity of the toner measured at 100° C. with a flow tester, and wherein the binder resin comprises a resin having a weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000.

20. The toner according to claim 19, wherein η100 is in the range of about $2.5\times10^3$ to about $5.5\times10^3$ Pa·s and η120 is in the range of about $1.5\times10^2$ to about $6.55\times10^2$ Pa·s.

21. The toner according to claim 20, wherein the binder resin comprises a resin selected from the group consisting of polyester resins and epoxy resins.

22. The toner according to claim 19, wherein the colorant is a pigment or dye selected from the group consisting of carbon black, lamp black, iron black, ultramarine blue, Nigrosine dyes, Aniline blue, chalco-oil blue, DuPont Oil Red, Quinoline Yellow, Methylene Blue chloride, Phthalocyanine Blue, Phthalocyanine Green, Hansa Yellow, Rhodamine 6C Lake, chrome yellow, quinacridone, Benzidine Yellow, Malachite Green, Malachite Green hexalate, Oil Black, azo oil black, Rose Bengale, monoazo pigments, disazo pigments and trisazo pigments.

23. The toner according to claim 19, wherein the toner contains a polarity controlling agent.

24. The toner according to claim 19, wherein the toner contains a hydrophobized particulate filler which has an average primary particle diameter of 0.001 to 1 μ.

25. An image forming method comprising the steps of:

forming a toner image on a receiving material using a toner comprising a colorant and a binder resin, wherein the toner has the melt viscosity property:

$$0.06<\eta120/\eta100<0.15$$

wherein η120 is the melt viscosity of the toner measured at 120° C. with a flow tester, and η100 is the melt viscosity of the toner measured at 100° C. with a flow tester;

wherein the binder resin comprises a resin having a weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000; and heating the toner image to fix the toner image on the receiving material.

26. The image forming method according to claim 25, wherein η100 is within a range of from about $2.5\times10^3$ to about $5.5\times10^3$ Pa·s and η120 is within a range of from about $1.5\times10^2$ to about $6.55\times10^2$ Pa·s.

27. The image forming method according to claim 25, wherein the heating step is performed using a non-contact fixing device.

28. The image forming method according to claim 25, wherein, provided that the toner image has a gloss y when the heating temperature in the heating step is x, the gloss y changes depending on the heating temperature x such that the relationship between the gloss y and the heating temperature x, $y=f(x)$, is in the range between a line 1, $f(x)=0.08x-6$, and a line 2, $f(x)=0.6x-50$.

29. The image forming method according to claim 25, wherein the binder resin comprises a resin selected from the group consisting of polyester resins and epoxy resins.

30. An image forming method comprising the steps of:

forming color toner images constituted of a plurality of different color tone images on a receiving material using a plurality of color toners including a black toner, each of the plurality of color toners comprising a colorant and a binder resin, wherein each of the plurality of color toners has the following melt viscosity property:

$$0.06<\eta120/\eta100<0.15$$

wherein η120 is the melt viscosity of each of the plurality of color toners measured at 120° C. with a flow tester, and η100 is the melt viscosity of the color toner measured at 100° C. with a flow tester, wherein the binder resin of each of said color toners comprises a resin having an weight average molecular weight of from about 6000 to about 20000 and a molecular weight distribution of from about 100 to about 500000 and a resin having a weight average molecular weight of from about 4000 to about 8000 and a molecular weight distribution of from about 100 to about 10000; and heating the color toner images to fix the color toner images on the receiving material.

31. The image forming method according to claim 30, wherein η100 is within the range of from about $2.5\times10^3$ to about $5.5\times10^3$ Pa·s and η120 is within the range of from about $1.5\times10^2$ to about $6.55\times10^2$ Pa·s.

32. The image forming method according to claim 30, wherein the heating step is performed using a non-contact fixing device.

33. The image forming method according to claim 30, wherein, provided that each of the plurality of color tone images has a gloss $y_1, y_2, \ldots y_n$, when a heating temperature in the heating step is x, the gloss $y_n$ changes depending on the heating temperature x such that the relationship between the gloss $y_n$ and the heating temperature x, $y_n=f(x)$, is within the range between a line 1, $f(x)=0.08x-6$, and a line 2, $f(x)=0.6x-50$.

34. The image forming method according to claim 30, wherein the binder resin of each of the color toners comprises a resin selected from the group consisting of polyester resins and epoxy resins.

35. The image forming method according to claim 30, wherein the black toner has a higher melt viscosity than the other toners when measured at a heating temperature in the heating step.

36. The image forming method according to claim 35, wherein the melt viscosity of the black toner is less than about 1.1 times higher than the melt viscosity of the other toners.

* * * * *